US007808520B2

(12) United States Patent
Nakajima

(10) Patent No.: US 7,808,520 B2
(45) Date of Patent: Oct. 5, 2010

(54) EXPOSURE DEVICE, LIGHT EMITTING DIODE HEAD, AND IMAGE FORMING APPARATUS

(75) Inventor: Norio Nakajima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/219,182

(22) Filed: Jul. 17, 2008

(65) Prior Publication Data

US 2009/0028592 A1 Jan. 29, 2009

(30) Foreign Application Priority Data

Jul. 23, 2007 (JP) ..... 2007-190555

(51) Int. Cl.
*B41J 2/45* (2006.01)

(52) U.S. Cl. ..... 347/238

(58) Field of Classification Search ..... 347/149, 347/238, 241–244, 256–258
See application file for complete search history.

(56) References Cited

U.S. PATENT DOCUMENTS 6,801,232 B2 * 10/2004 Nagamine et al. ..... 347/149
7,502,045 B2 * 3/2009 Joichi et al. ..... 347/238

FOREIGN PATENT DOCUMENTS

JP 2003-011414 1/2003

* cited by examiner

*Primary Examiner*—Hai C Pham
(74) *Attorney, Agent, or Firm*—Kubotera & Associates LLC

(57) ABSTRACT

An exposure device includes a light emitting element; and an eccentric cam for adjusting a distance between the light emitting element and a light receiving member. The eccentric cam includes a shaft portion and a cam portion arranged eccentrically relative to the shaft portion. The cam portion includes a circumferential surface having a convex surface in an axial direction of the eccentric cam and a circular arc in a direction perpendicular to the axial direction.

9 Claims, 12 Drawing Sheets

EXPOSURE DEVICE, LIGHT EMITTING DIODE HEAD, AND IMAGE FORMING APPARATUS

BACKGROUND OF THE INVENTION

The present invention relates to an exposure device, a light emitting diode (LED) head, and an image forming apparatus.

In a conventional image forming apparatus such as a printer, a copier, a facsimile, and the likes, an LED head may be used as an exposure device. In this case, an LED array chip constituting the LED head emits light, and a rod lens array as an optical system with light convergence property collects light when light passes therethrough. Accordingly, light is radiated on a photosensitive drum as an image supporting member disposed at an image forming location, thereby forming a static latent image.

In the conventional image forming apparatus, a pin is provided for adjusting a distance between the rod lens array and the photosensitive drum, that is, a distance between a radiation end surface or an end surface of the rod lens array emitting light therefrom and a surface of the photosensitive drum (refer to Patent Reference).

Patent Reference: Japan Patent Publication No. 2003-11414

In the conventional image forming apparatus, it is necessary to select and install a pin having an appropriate length for adjusting the radiation end surface and the surface of the photosensitive drum.

In the present invention, it is possible to accurately adjust a distance between an optical system and an image supporting member, and to make an adjustment operation simple.

SUMMARY OF THE INVENTION

According to a first aspect of the present invention, an exposure device includes a light emitting element; and an eccentric cam for adjusting a distance between the light emitting element and a light receiving member. The eccentric cam includes a shaft portion and a cam portion arranged eccentrically relative to the shaft portion. The cam portion includes a circumferential surface having a convex surface in an axial direction of the eccentric cam and a circular arc in a direction perpendicular to the axial direction.

According to a second aspect of the present invention, an exposure device includes a light emitting element; a supporting member for supporting the light emitting element; and an eccentric cam for adjusting a distance between the light emitting element and a light receiving member. The eccentric cam includes a shaft portion and a cam portion arranged eccentrically relative to the shaft portion. The cam portion is supported on a holding portion formed on the supporting member to be rotatable.

According to a third aspect of the present invention, an LED (Light Emitting Diode) head includes an LED array chip formed of a plurality of LEDs; an optical system disposed between the LED array chip and a light receiving member for collecting light emitted from the LEDs; and an eccentric cam disposed between the optical system and the light receiving member to be rotatable for adjusting a distance between the optical system and the light receiving member. The eccentric cam includes a shaft portion and a cam portion arranged eccentrically relative to the shaft portion. The cam portion includes a circumferential surface having a convex surface in an axial direction of the eccentric cam and a circular arc in a direction perpendicular to the axial direction.

According to a fourth aspect of the present invention, an LED head includes an LED array chip formed of a plurality of LEDs; an optical system disposed between the LED array chip and a light receiving member for collecting light emitted from the LEDs; a supporting member for supporting the optical system; and an eccentric cam disposed between the optical system and the light receiving member to be rotatable for adjusting a distance between the optical system and the light receiving member. The eccentric cam includes a shaft portion and a cam portion arranged eccentrically relative to the shaft portion. The cam portion is supported on a holding portion formed on the supporting member to be rotatable.

According to a fifth aspect of the present invention, an image forming apparatus includes one of the exposure devices according to the first and second aspects.

In the present invention, the cam portion includes the circumferential surface having the convex surface in the axial direction of the eccentric cam and the circular arc in the direction perpendicular to the axial direction. Accordingly, the circumferential surface abuts against and contacts with an abutting surface of a spacer disposed on a surface of the light receiving member at a position protruding most in the axial direction of the eccentric cam.

With the configuration described above, even when the circumferential surface has undulation due to an accuracy variance during a manufacturing process, the circumferential abuts against the abutting surface at a constant location. Accordingly, it is possible to maintain a constant distance between the light emitting element and the light receiving member, and to prevent a focal point from shifting. As a result, it is possible to accurately adjust the distance between the light emitting element and the light receiving member, and to simplify an adjustment operation.

Further, in the present invention, the cam portion rotates while being supported on the holding portion formed on the supporting member. Accordingly, it is possible to reduce a change in a position where the circumferential surface of the cam portion contacts with the abutting surface of the spacer disposed on the surface of the light receiving member. Accordingly, it is possible to accurately adjust the distance between the light emitting element and the light receiving member, and to simplify an adjustment operation.

DETAILED DESCRIPTION OF THE PREFERRED EMBODIMENTS

Hereunder, embodiments of the present invention will be described in more detail with reference to the accompanying drawings. A printer will be explained as an image forming apparatus.

First Embodiment

Figure 2:
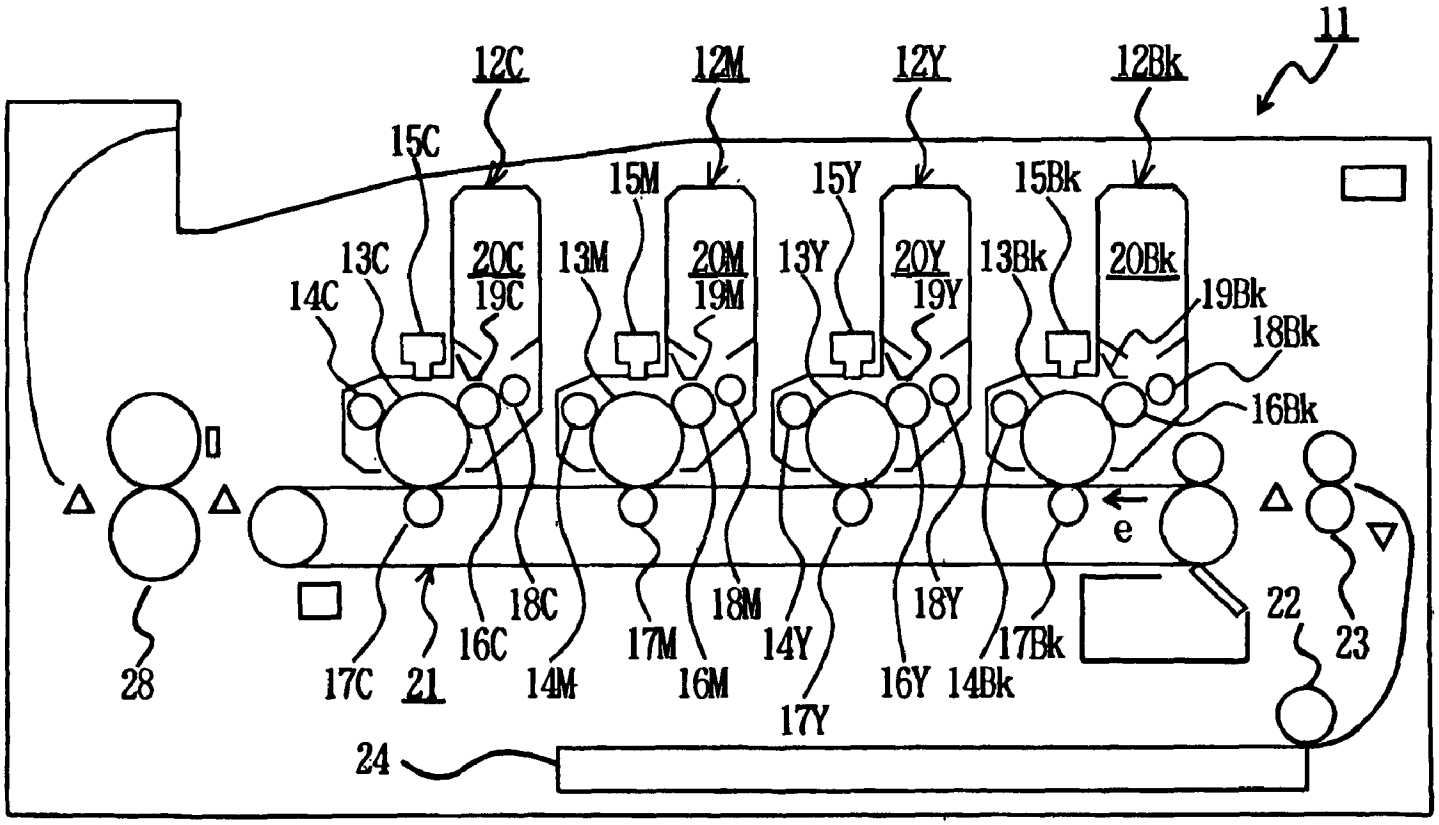
FIG. 2 is a schematic sectional view showing a printer according to the first embodiment of the present invention.

A first embodiment of the present invention will be explained. FIG. 2 is a schematic sectional view showing a printer 11 according to the first embodiment of the present invention.

As shown in FIG. 2, the printer 11 includes four separate image forming units 12Bk, 12Y, 12M, and 12C constituting image forming portions arranged from an insertion side of a sheet as a medium to a discharge side thereof. The image forming units 12Bk, 12Y, 12M, and 12C form images in black, yellow, magenta, and cyan, respectively. In addition to the sheet, the medium may includes an OHP (Over Head Projector) sheet, an envelope, a copy paper, a special paper, and the likes.

In the embodiment, the image forming units 12Bk, 12Y, 12M, and 12C include photosensitive drums 13Bk, 13Y, 13M, and 13C as light receiving members and image supporting members; charge rollers 14Bk, 14Y, 14M, and 14C for uniformly charging surfaces of the photosensitive drums 13Bk, 13Y, 13M, and 13C; developing rollers 16Bk, 16Y, 16M, and 16C as developer supporting members for attaching toner (not shown) as developer to static latent images as latent images formed on the surfaces of the photosensitive drums 13Bk, 13Y, 13M, and 13C to form toner images as developer images in each color.

In the embodiment, toner supply rollers 18Bk, 18Y, 18M, and 18C as developer supply members are arranged to abut against the developing rollers 16Bk, 16Y, 16M, and 16C, respectively. The toner supply rollers 18Bk, 18Y, 18M, and 18C supply toner supplied from toner cartridges as developer cartridges 20Bk, 20Y, 20M, and 20C to the developing rollers 16Bk, 16Y, 16M, and 16C.

In the embodiment, developing blades 19Bk, 19Y, 19M, and 19C as developer regulating members are pressed against the developing rollers 16Bk, 16Y, 16M, and 16C. The developing blades 19Bk, 19Y, 19M, and 19C form a thin layer of toner supplied from the toner supply rollers 18Bk, 18Y, 18M, and 18C on the developing rollers 16Bk, 16Y, 16M, and 16C.

In the image forming units 12Bk, 12Y, 12M, and 12C, LED (Light Emitting Diode) heads 15Bk, 15Y, 15M, and 15C as exposure devices are arranged above the photosensitive drums 13Bk, 13Y, 13M, and 13C to face the same. The LED heads 15Bk, 15Y, 15M, and 15C expose the photosensitive drums 13Bk, 13Y, 13M, and 13C according to image data in each color for forming the static latent images.

Further, in the image forming units 12Bk, 12Y, 12M, and 12C, transfer unit is arranged under the photosensitive drums 13Bk, 13Y, 13M, and 13C. The transfer unit includes a transportation belt 21 as a transportation member disposed to be freely movable in an arrow direction e. The transfer unit further includes transfer rollers 17Bk, 17Y, 17M, and 17C as transfer members arranged to face the photosensitive drums 13Bk, 13Y, 13M, and 13C with the transportation belt 21 inbetween for charging a sheet with a polarity opposite to that of toner to transfer the toner images in each color to the sheet.

In the embodiment, a sheet supply mechanism is provided at a lower portion of the printer. The sheet supply mechanism includes a hopping roller 22; a register roller 23; a sheet storage cassette 24 as a medium storage portion; and the likes. The hopping roller 22 picks up the sheet in the sheet storage cassette 24, and transports the sheet to the register roller 23. Then, the register roller 23 transports the sheet to the transportation belt 21.

While the transportation belt 21 is rotating to transport the sheet, the transfer rollers 17Bk, 17Y, 17M, and 17C transfer the toner images in each color to the sheet in the image forming units 12Bk, 12Y, 12M, and 12C, thereby forming a color toner image. After the color toner image is formed on the sheet, the sheet is transported to a fixing device 28. Accordingly, the fixing device 28 fixes the color toner image to the sheet, thereby forming a color image.

A relationship between the photosensitive drums 13Bk, 13Y, 13M, and 13C and the LED heads 15Bk, 15Y, 15M, and 15C will be explained next. In the image forming units 12Bk, 12Y, 12M, and 12C, the photosensitive drums 13Bk, 13Y, 13M, and 13C and the LED heads 15Bk, 15Y, 15M, and 15C have an identical relationship. Accordingly, only a relationship between the photosensitive drum 13Bk and the LED head 15Bk will be explained.

Figure 3:
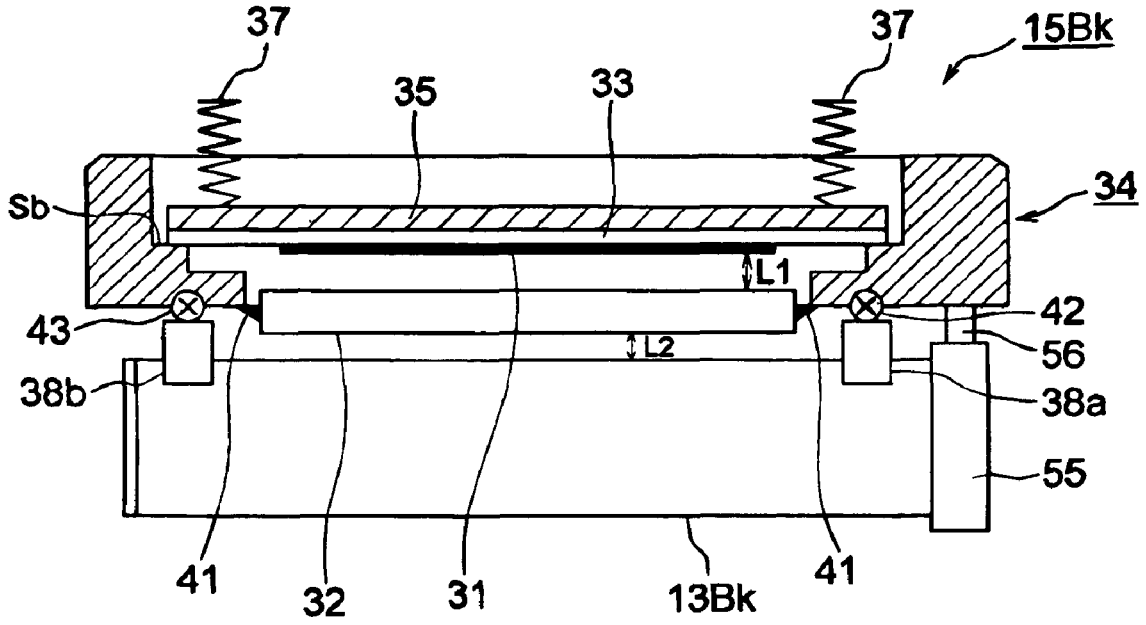
FIG. 3 is a schematic vertical sectional view showing an LED (Light Emitting Diode) head according to the first embodiment of the present invention.
Figure 4:
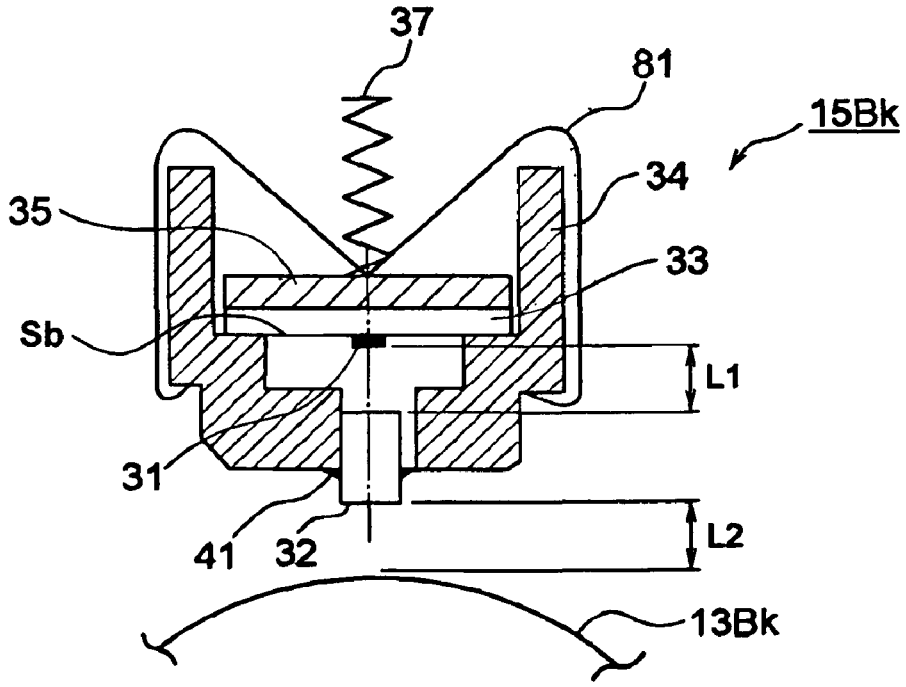
FIG. 4 is a schematic lateral sectional view showing the LED head according to the first embodiment of the present invention.

FIG. 3 is a schematic vertical sectional view showing the LED head 15Bk according to the first embodiment of the present invention. FIG. 4 is a schematic lateral sectional view showing the LED head 15Bk according to the first embodiment of the present invention.

As shown in FIGS. 3 and 4, an LED array chip 31 as a light emitting element array formed of a plurality of LEDs as light emitting elements is disposed to face the photosensitive drum 13Bk. A rod lens array 32 as an optical system or a lens array is disposed between the LED array chip 31 and the photosensitive drum 13Bk, and has light convergence property for collecting light emitting from the LEDs. A circuit board 33 has an LED array chip 31 and a driver IC (Integrated Circuit, not shown) for controlling the LED array chip 31 mounted thereon.

In the embodiment, a lens array holder 34 as a chassis or a supporting member supports the rod lens array 32, and the circuit board 33 is mounted on the lens array holder 34. The lens array holder 34 is formed of a die-cast product molded through casting aluminum into a mold. A side plate 55 supports the photosensitive drum 13Bk to be freely rotatable.

In the embodiment, after the rod lens array 32 is fixed to the lens array holder 34, a silicone sealing 41 is filled in a space between the rod lens array 32 and the lens array holder 34 for blocking light or a foreign matter. A cramp 81 presses the circuit board 33 against a board abutting surface Sb of the lens array holder 34 through a base 35. A positioning pin 56 is provided for positioning the lens array holder 34 relative to the photosensitive drum 13Bk. Note that the LED head 15Bk is arranged to face the photosensitive drum 13Bk.

In order to radiate light for accurately forming an image on the photosensitive drum 13Bk, it is necessary to adjust a distance L2 to be equal to a distance L1 (L1=L2), in which the distance L1 is a distance between a surface of the LED array chip 31 and an end surface of the rod lens array 32 where light is incident or an incident end surface, and the distance L2 is a distance between a surface of the photosensitive drum 13Bk and an outgoing end surface of the rod lens array 32.

To this end, in the embodiment, eccentric cams 42 and 43 as adjusting members are disposed near end portions of the lens array holder 34 in a longitudinal direction thereof for adjusting the distances L1 and L2 while rotating. The eccentric cams 42 and 43 are arranged to abut against spacers 38*a* and 38*b* disposed on the surface of the photosensitive drum 13Bk.

In the embodiment, coil springs 37 as urging members are disposed on both end portions of the base 35 for urging the LED head 15Bk toward the photosensitive drum 13Bk. Accordingly, the eccentric cams 42 and 43 abut against abutting surfaces of the spacers 38*a* and 38*b* (at arbitrary heights so that the distance L1 becomes equal to the distance L2) for adjusting the distance L2 and maintaining the same constant.

Figure 5:
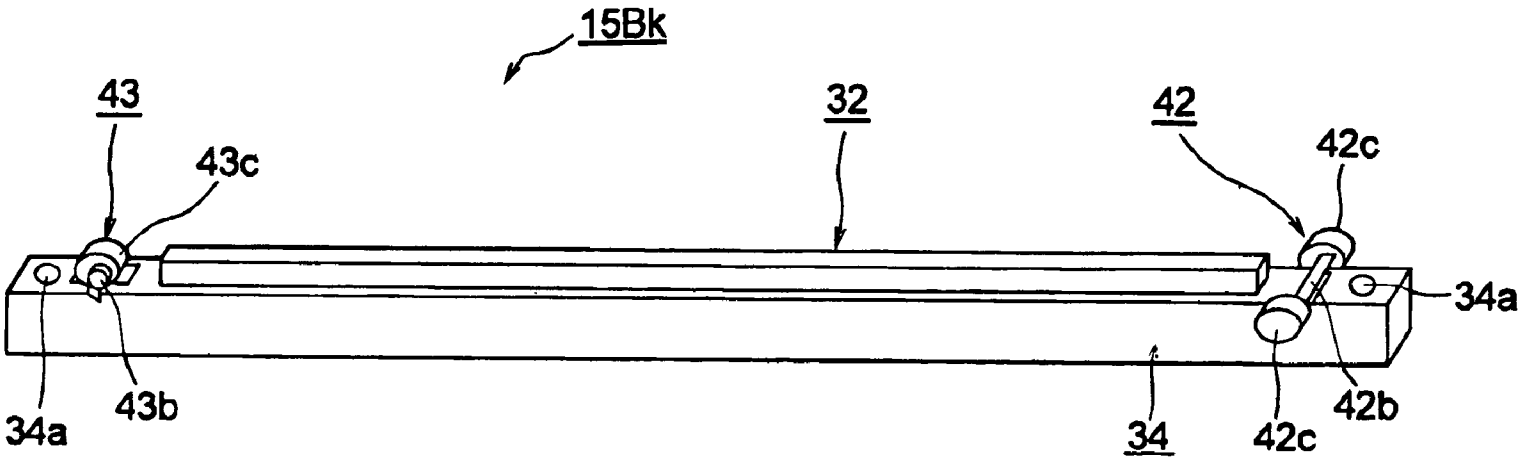
FIG. 5 is a schematic perspective view showing the LED head according to the first embodiment of the present invention.

An arrangement of the eccentric cams 42 and 43 will be explained next. FIG. 5 is a schematic perspective view showing the LED head 15Bk according to the first embodiment of the present invention.

As shown in FIG. 5, the eccentric cam 42 includes a shaft portion 42*b*, and cam portions 42*c* integrally disposed at both end portions of the shaft portion 42*b* and formed in a circular shape. The cam portions 42*c* are arranged on an axial line shifted from an axial line of the shaft portion 42*b* by a specific amount. Further, the eccentric cam 43 includes shaft portions 43*b* disposed at both end portions thereof, and a cam portion 43*c* integrally disposed between the shaft portions 43*b* and formed in a circular shape. The cam portion 43*c* is arranged on an axial line shifted from an axial line of the shaft portions 43*b* by a specific amount.

In the embodiment, positioning holes 34*a* are formed at both end portions of the lens array holder 34. The positioning pin 56 formed on the side plate 55 (refer to FIG. 3) is inserted into the positioning hole 34*a*, so that the lens array holder 34 is positioned relative to the photosensitive drum 13Bk.

A method of adjusting the distance L2 between the outgoing end surface of the rod lens array 32 and the surface of the photosensitive drum 13Bk, or a distance adjustment method, will be explained next.

Figure 6:
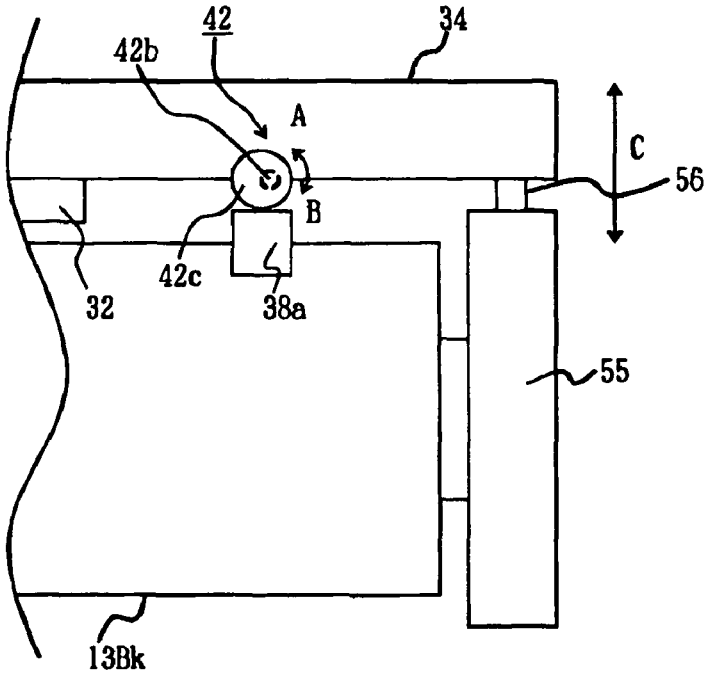
FIG. 6 is a schematic view No. 1 showing a distance adjustment method according to the first embodiment of the present invention.
Figure 7:
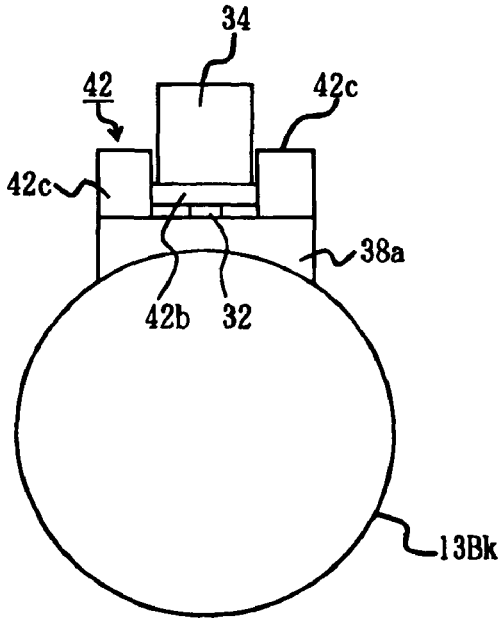
FIG. 7 is a schematic view No. 2 showing the distance adjustment method according to the first embodiment of the present invention.
Figure 8:
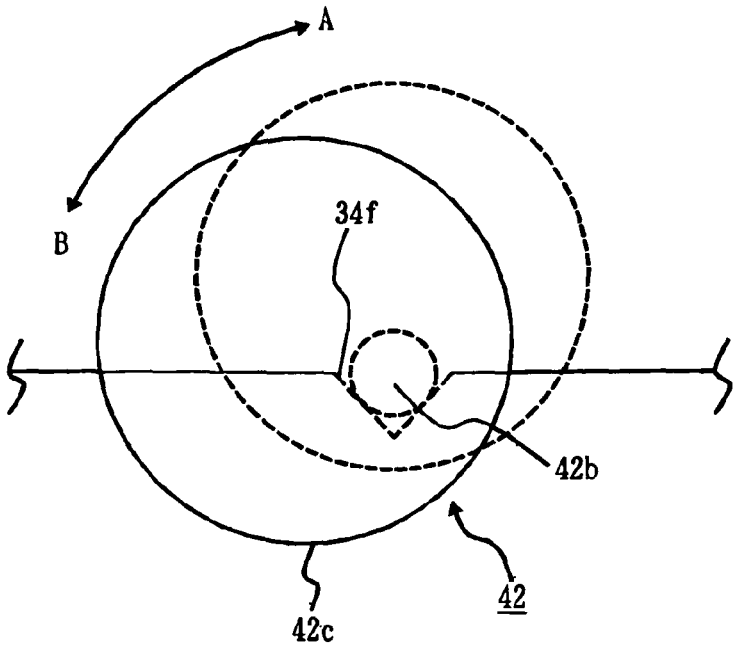
FIG. 8 is a schematic view showing an operation of the eccentric cam according to the first embodiment of the present invention.

FIG. 6 is a schematic view No. 1 showing the distance adjustment method according to the first embodiment of the present invention. FIG. 7 is a schematic view No. 2 showing the distance adjustment method according to the first embodiment of the present invention. FIG. 8 is a schematic view showing an operation of the eccentric cam 42 according to the first embodiment of the present invention.

As described above, the eccentric cams 42 and 43 abut against the abutting surfaces of the spacer 38*a* and 38*b* (refer to FIG. 3) for adjusting the distance L2. The shaft portions 42*b* and 43*b* of the eccentric cams 42 and 43 are situated grooves 34*f* as retaining portions of the lens array holder 34 having a V character shape. Accordingly, the eccentric cams 42 and 43 are attached to the lens array holder 34 to be rotatable in arrow directions A and B in advance for adjusting a position of the lens array holder 34 relative to the photosensitive drum 13Bk in an arrow direction C.

As described above, the positioning pin 56 formed on the side plate 55 is inserted into the positioning hole 34*a* (refer to FIG. 5) formed in the lens array holder 34, so that the lens array holder 34 is positioned relative to the photosensitive drum 13Bk in the arrow direction C.

Figure 9:
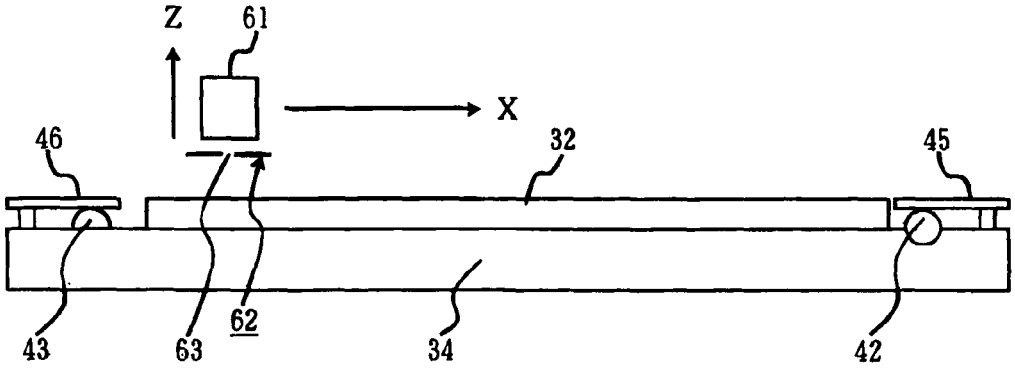
FIG. 9 is a schematic view showing a method of adjusting a focus of a rod lens array according to the first embodiment of the present invention.
Figure 10:
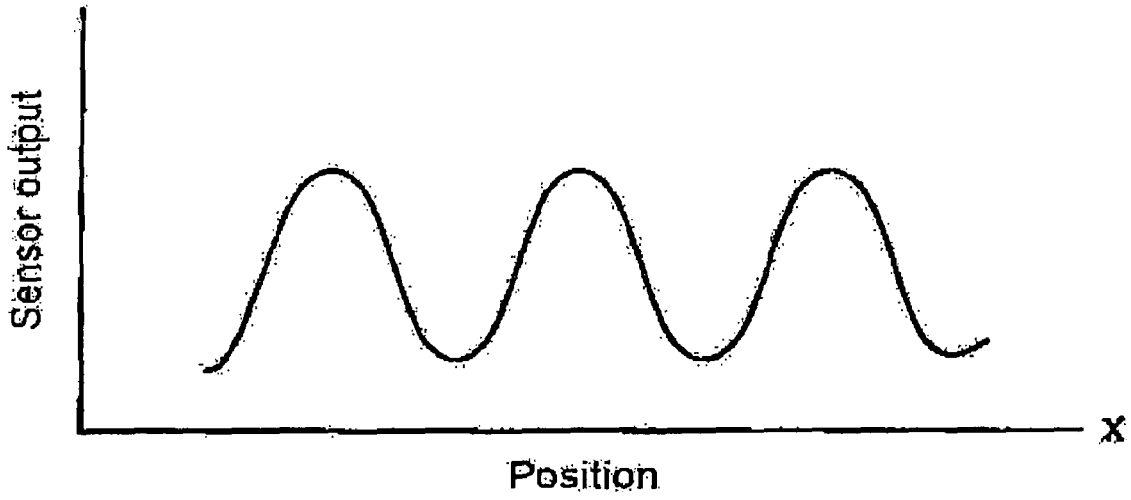
FIG. 10 is a graph showing an output of an optical sensor according to the first embodiment of the present invention.

A method of adjusting a focus of the rod lens array 32 will be explained next. FIG. 9 is a schematic view showing the method of adjusting the focus of the rod lens array 32 according to the first embodiment of the present invention. FIG. 10 is a graph showing an output of an optical sensor according to the first embodiment of the present invention. In FIG. 10, a horizontal axis represents a position, and a vertical axis represents a sensor output.

When the focus of the rod lens array 32 is adjusted, the LED head 15Bk (refer to FIG. 3) is attached to a measurement device in advance. Accordingly, the measurement device is provided with plates 45 and 46 as abutting members corresponding to the spacers 38*a* and 38*b*, so that the eccentric cams 42 and 43 abut against the plates 45 and 46.

Further, a slit member 62 is arranged in front of a sensor 61 while the LED head 15Bk is emitting light, and the sensor 61 moves and scans a focal point, that is, near the focal point in a direction X shown in FIG. 9. A specific slit 63 is formed in the slit member 62 for passing light radiated from the LED head 15Bk therethrough. Note that the plates 45 and 46 are fixed to the measurement device. When the eccentric cams 42 and 43 rotate while abutting against the plates 45 and 46, it is possible to adjust a distance between the LED head 15Bk and the sensor 61 at a left end portion and a right end portion of the LED head 15Bk.

When the sensor 61 scans, a sensor output shown in FIG. 10 is obtained. A value MTF is given by the following equation:

$$MTF=((O\max-O\min)/(O\max+O\min))\times 100\%$$

where Omax is a maximum value of the sensor output of the sensor 61, and Omin is a minimum value of the sensor output of the sensor 61.

Afterward, the sensor 61 is shifted in a direction Z in shown FIG. 9 little by little. The scanning of the sensor 61 is repeated at each position, and the value MTF is calculated. The focal point is determined as a position in the direction Z where the value MTF becomes maximum.

Afterward, the focal point thus measured, or a measured focal point, is compared with a focal point to be a target, or a target focal point. When the measured focal point is different from the target focal point, the eccentric cams 42 and 43 rotate such that the measured focal point becomes equal to the target focal point. When the measured focal point becomes equal to the target focal point, and the focus adjustment is completed, the eccentric cams 42 and 43 are fixed to the lens array holder 34 with an adhesive (not shown).

After the focus adjustment is completed, the LED head 15Bk is installed into the printer 11 (refer to FIG. 2). Accordingly, as described above, the eccentric cams 42 and 43 abut against the spacers 38*a* and 38*b* disposed on the photosensitive drum 13Bk, thereby maintaining the distance L2 constant.

In an actual case, outer circumferential surfaces of the eccentric cams 42 and 43 are not perfect flat surfaces due to a variance in manufacturing accuracy. Accordingly, the eccentric cams 42 and 43 tend to abut against the spacers 38*a* and 38*b* in various states, thereby shifting the focal point.

Figure 11:
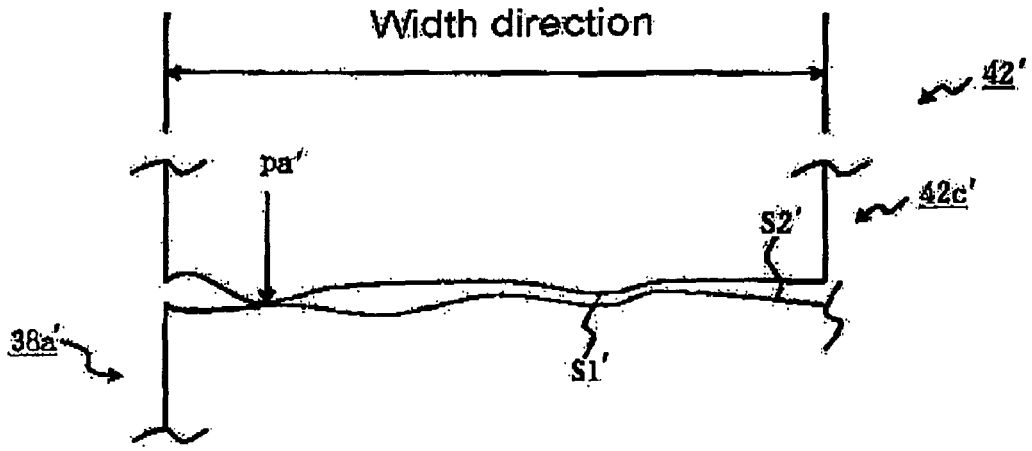
FIG. 11 CONVENTIONAL ART
FIG. 11 is a schematic view No. 1 showing a relationship between an eccentric cam and a spacer of a conventional image forming apparatus.
Figure 12:
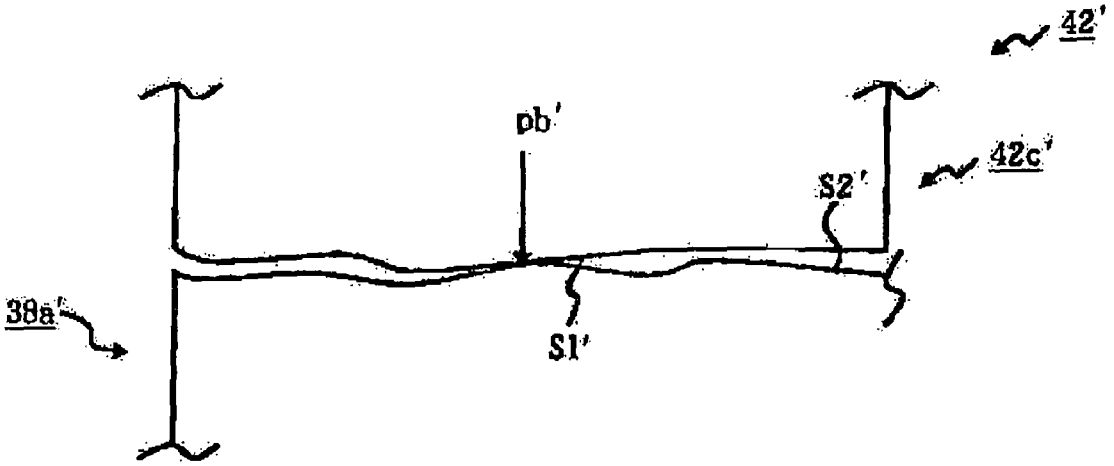
FIG. 12 CONVENTIONAL ART
FIG. 12 is a schematic view No. 2 showing the relationship between the eccentric cam and the spacer of the conventional image forming apparatus.

FIG. 11 is a schematic view No. 1 showing a relationship between an eccentric cam 42' and a spacer 38*a*' of a conventional image forming apparatus. FIG. 12 is a schematic view No. 2 showing the relationship between the eccentric cam 42' and the spacer 38*a*' of the conventional image forming apparatus. In the following description, among the eccentric cams 42' and 43', only the eccentric cam 42' will be explained.

As shown in FIGS. 11 and 12, when an outer circumferential surface S1' of the eccentric cam 42' and an abutting surface S2 of the spacer 38*a*' have undulation, the outer circumferential surface S1' contacts with the abutting surface S2 at different locations pa' and pb' in a width direction of the eccentric cam 42'.

Even when the abutting surface S2' the spacer 38*a*' has a well-controlled variance in a height of the undulation, it is difficult to similarly control the variance at a plurality of locations. Similarly, in the case of the eccentric cams 42' and 43', it is difficult to similarly control a variance in a height of the undulation thereof at a plurality of locations.

Accordingly, when a cam portion 42*c*' rotates to adjust the distance L2, the cam portion 42*c*' contacts with the spacer 38*a*' at various locations as shown in FIGS. 11 and 12, thereby making it difficult to adjust the distance L2. Further, the spacer 38*a*' and, for example, the plate 45 of the measuring device have the abutting surfaces with different undulation. Accordingly, when the cam portion 42*c*' rotates to securely adjust the distance L2 on the plate 45 of the measuring device, the cam portion 42*c*' contacts with the plate 45 at a location different from that of the cam portion 42*c*' relative to the spacer 38*a*'. As a result, the distance L2 (refer to FIG. 4) tends to vary, thereby shifting the focal point.

Figure 1:
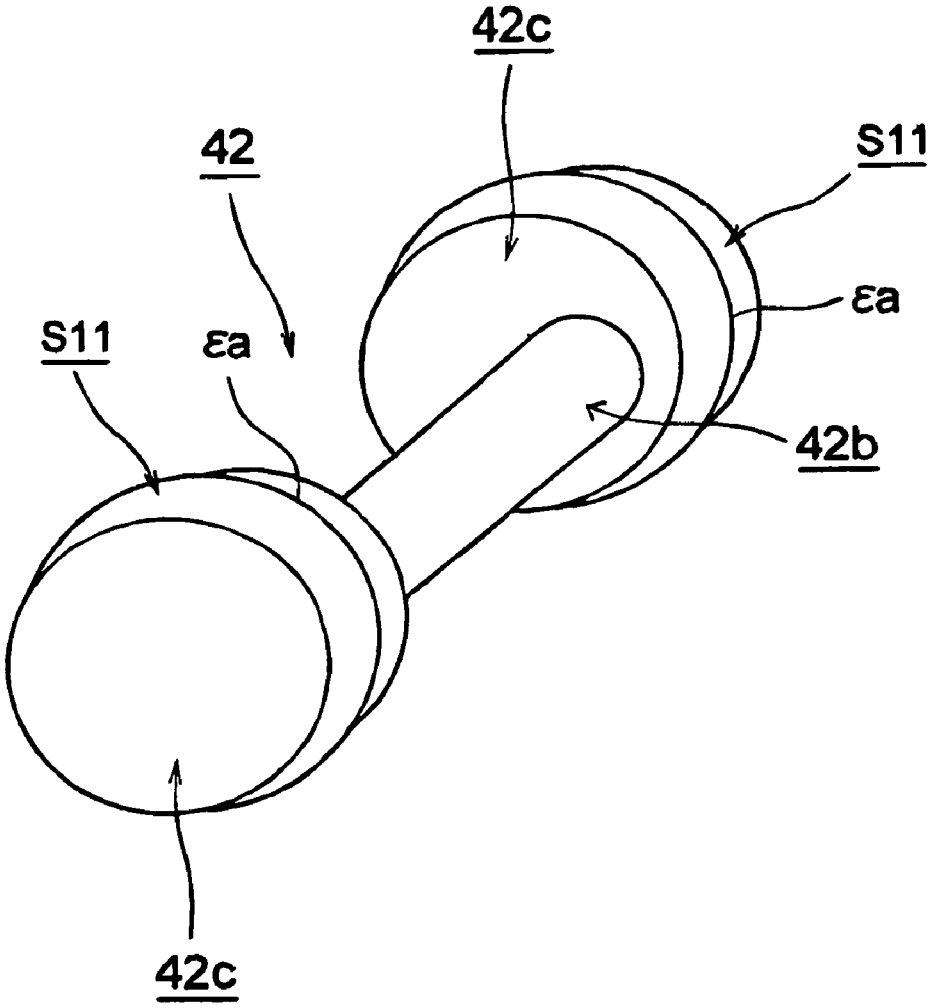
FIG. 1 is a schematic perspective view showing an eccentric cam according to a first embodiment of the present invention.
Figure 13:
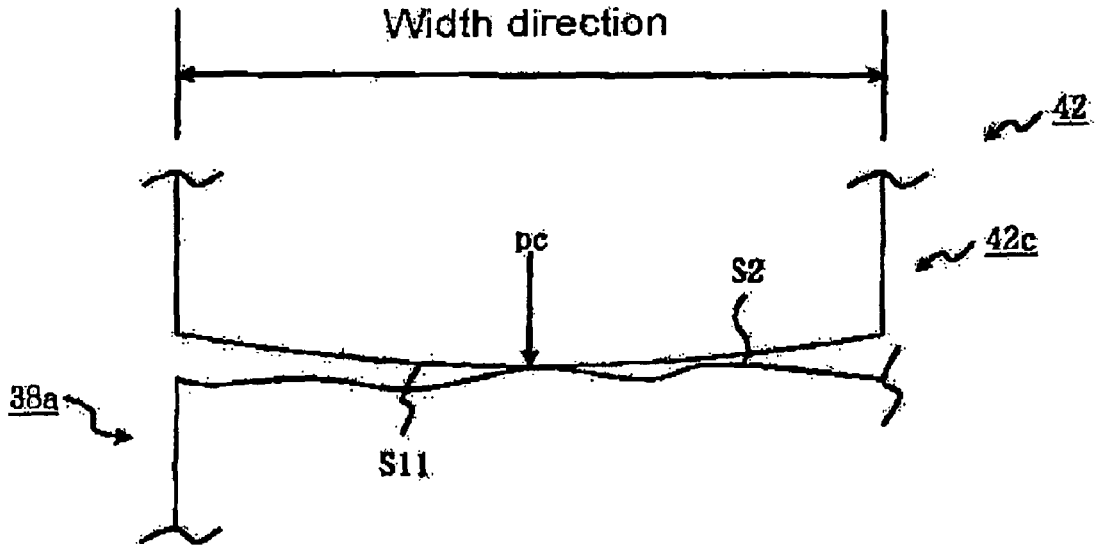
FIG. 13 is a schematic view showing a relationship between the eccentric cam and a spacer according to the first embodiment of the present invention.

In the embodiment, the outer circumferential surface of the cam portion 42*c* is curved in an axial direction of the eccentric cam 42. FIG. 1 is a schematic perspective view showing the eccentric cam 42 according to a first embodiment of the present invention. FIG. 13 is a schematic view showing a relationship between the eccentric cam 42 and the spacer 38*a* according to the first embodiment of the present invention.

As shown in FIG. 1, the eccentric cam 42 includes the shaft portion 42*b* and the cam portions 42*c*. Each of the cam portions 42*c* has an outer circumferential surface S11. The outer circumferential surface S11 is curved at a specific curvature in the axial direction (width direction) of the eccentric cam 42. Further, the outer circumferential surface S11 is formed of a convex surface with an arc shape protruding at a specific location in the axial direction or a center portion thereof. Note that an imaginary line ϵa represents a centerline of the cam portion 42*c* in the axial direction thereof.

In the embodiment, each of the outer circumferential surfaces S11 is formed of the convex surface with the arc shape, and may be formed of a convex surface with a polygonal shape.

As described above, in the embodiment, each of the outer circumferential surfaces S11 is formed of the convex surface. Accordingly, the outer circumferential surface S11 abuts against and contacts with the abutting surface S2 at a location pc, where the eccentric cam 42 protrudes to a largest extent in the width direction thereof.

Even when the outer circumferential surfaces S11 have undulation due to a variance in manufacturing accuracy, the outer circumferential surface S11 constantly contacts with the abutting surface S2 at the location pc. Accordingly, it is possible to stably maintain the distance L2, thereby preventing the focal point from shifting. As a result, it is possible to accurately adjust the distance between the rod lens array 32 and the photosensitive drum 13Bk, and to make the adjustment operation simple.

Second Embodiment

A second embodiment of the present invention will be described below.

In general, the spacer 38*a* has a thickness controlled in the manufacturing process. However, when the abutting surface S2 of the spacer 38*a* has undulation, it is difficult to control the thickness of the spacer 38*a* over a whole portion thereof. In an actual case, the thickness of the spacer 38*a* is measured at one specific location thereof for controlling the thickness.

Figure 14:
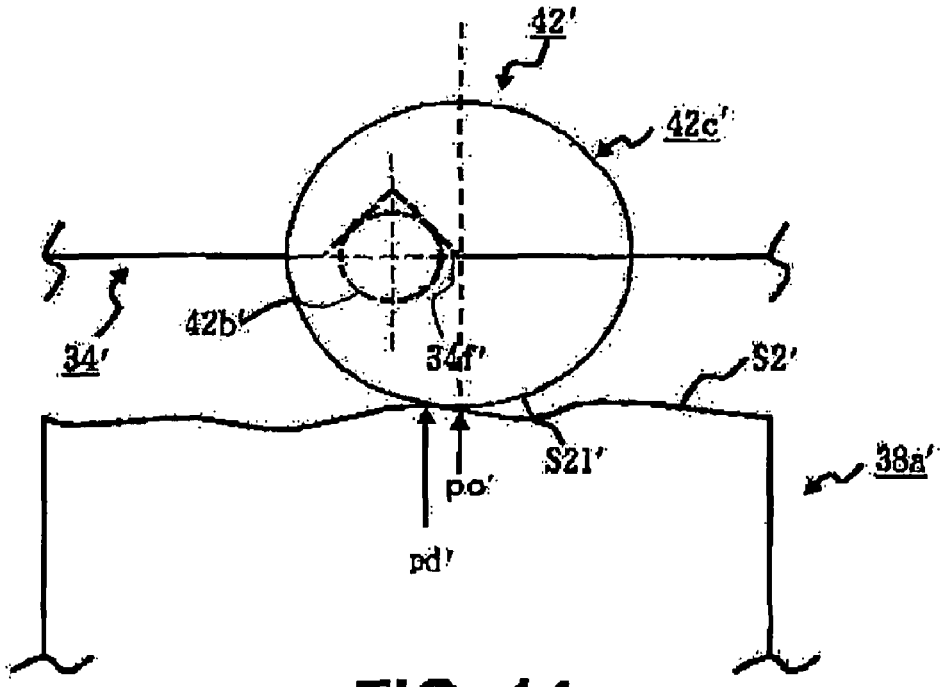
FIG. 14 CONVENTIONAL ART
FIG. 14 is a schematic view No. 3 showing the relationship between the eccentric cam and the spacer of the conventional image forming apparatus.
Figure 15:
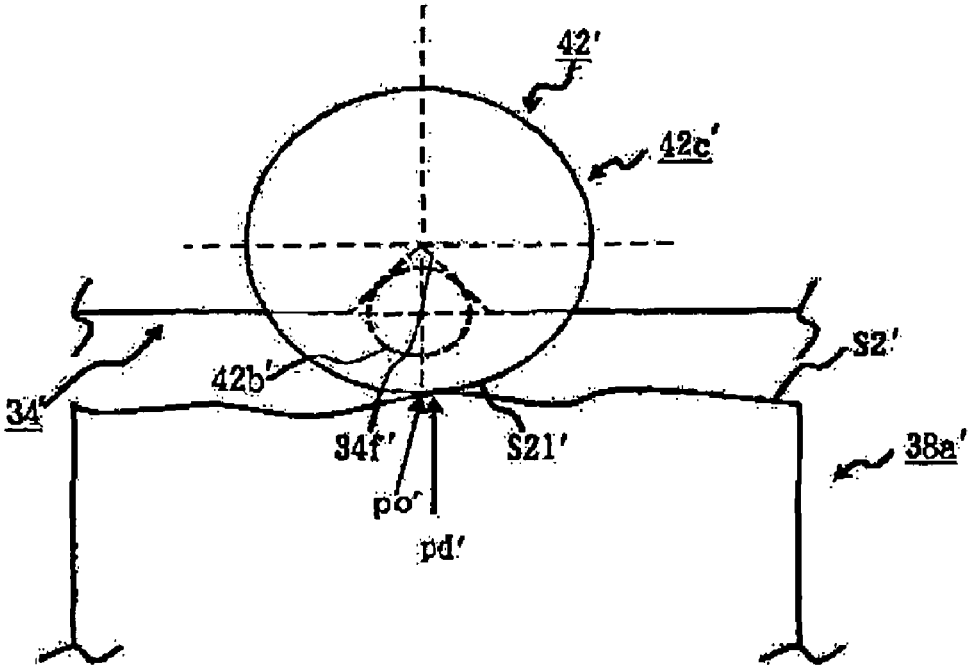
FIG. 15 CONVENTIONAL ART
FIG. 15 is a schematic view No. 4 showing the relationship between the eccentric cam and the spacer of the conventional image forming apparatus.
Figure 16:
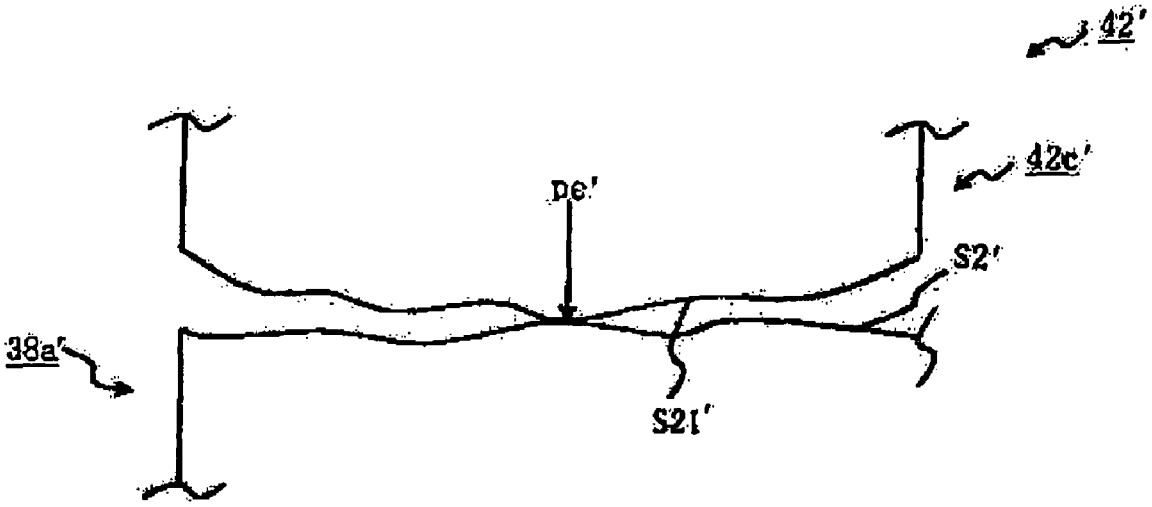
FIG. 16 CONVENTIONAL ART
FIG. 16 is a schematic view No. 5 showing the relationship between the eccentric cam and the spacer of the conventional image forming apparatus.

FIG. 14 is a schematic view No. 3 showing the relationship between the eccentric cam 42' and the spacer 38*a*' of the conventional image forming apparatus. FIG. 15 is a schematic view No. 4 showing the relationship between the eccentric cam 42' and the spacer 38*a*' of the conventional image forming apparatus. FIG. 16 is a schematic view No. 5 showing the relationship between the eccentric cam 42' and the spacer 38*a*' of the conventional image forming apparatus.

In the conventional image forming apparatus, when the distance L2 (refer to FIG. 4) is adjusted, the cam portion 42*c*' of the eccentric cam 42' rotates around a shaft portion 42*b*', while the shaft portion 42*b*' of the eccentric cam 42' is situated in a groove 34*f*' formed in a lens holder 34'. As shown in FIGS. 14 to 16, when an abutting surface S2' of the spacer 38*a* has undulation, an outer circumferential surface S21' of the cam portion 42*c*' abuts against the abutting surface S2'; at various locations.

For example, the cam portion 42*c*' is supposed to abut against the abutting surface S2' of the spacer 38*a*' at a lowest point po'. However, due to the undulation of the spacer 38*a*', the cam portion 42*c*' abuts against the abutting surface S2' of the spacer 38*a*' at a contact point pd'. Further, the contact point pd' is shifted according to an angle of the cam portion 42*c*', thereby changing a distance between the lowest point po' and the contact point pd' according to the angle.

Accordingly, as described above, when the contact point is shifted, the outer circumferential surface S21' may abut against the abutting surface S2' at a position pe', where the thickness is not properly controlled, thereby changing the distance L2 and shifting the focal point.

In the second embodiment, it is configured such that, when an angle of the cam portion 42*c* relative to the shaft portion 42*b* changes, the outer circumferential surface S21 contacts with the abutting surface S2 at a constant position.

Figure 17:
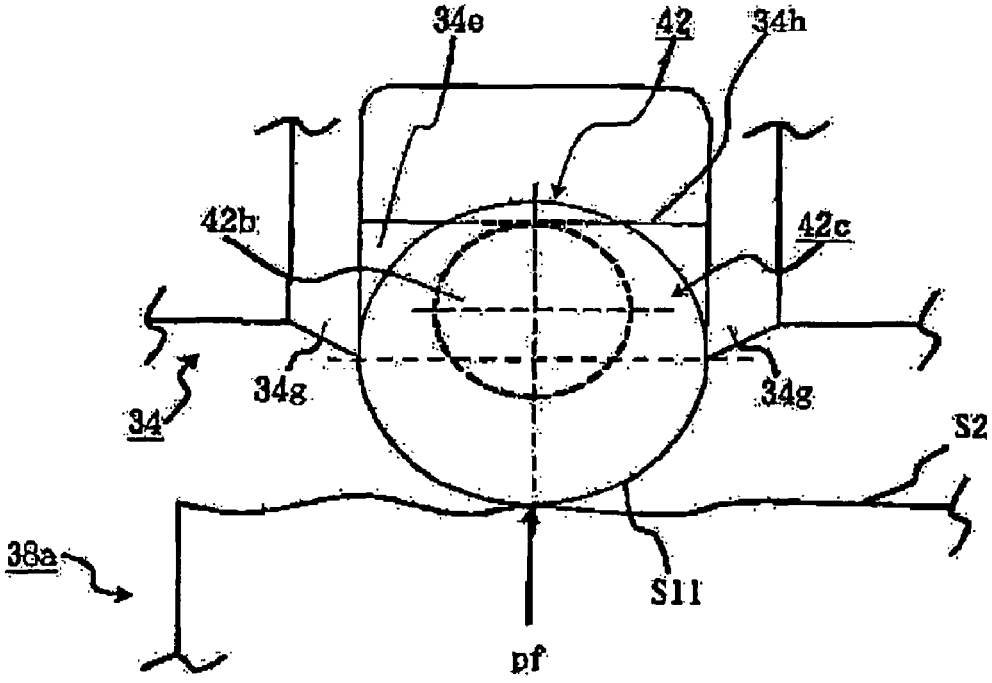
FIG. 17 is a schematic view No. 1 showing a relationship between an eccentric cam and a spacer according to a second embodiment of the present invention.
Figure 18:
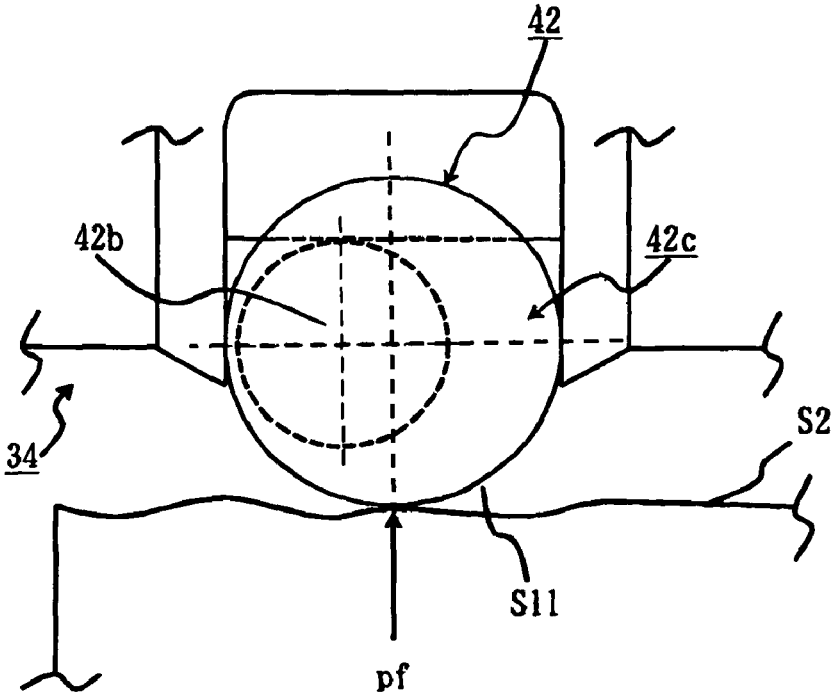
FIG. 18 is a schematic view No. 2 showing the relationship between the eccentric cam and the spacer according to the second embodiment of the present invention.
Figure 19:
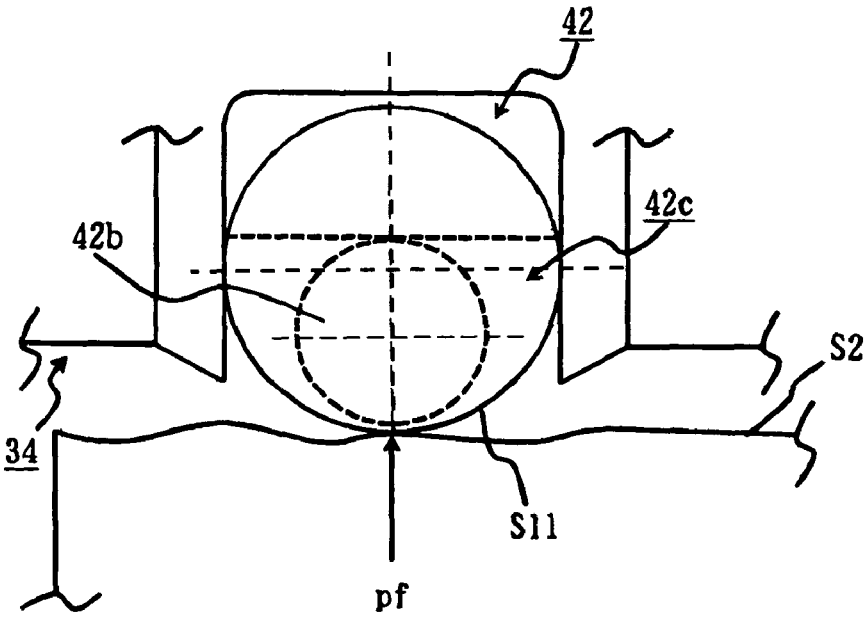
FIG. 19 is a schematic view No. 3 showing the relationship between the eccentric cam and the spacer according to the second embodiment of the present invention.
Figure 20:
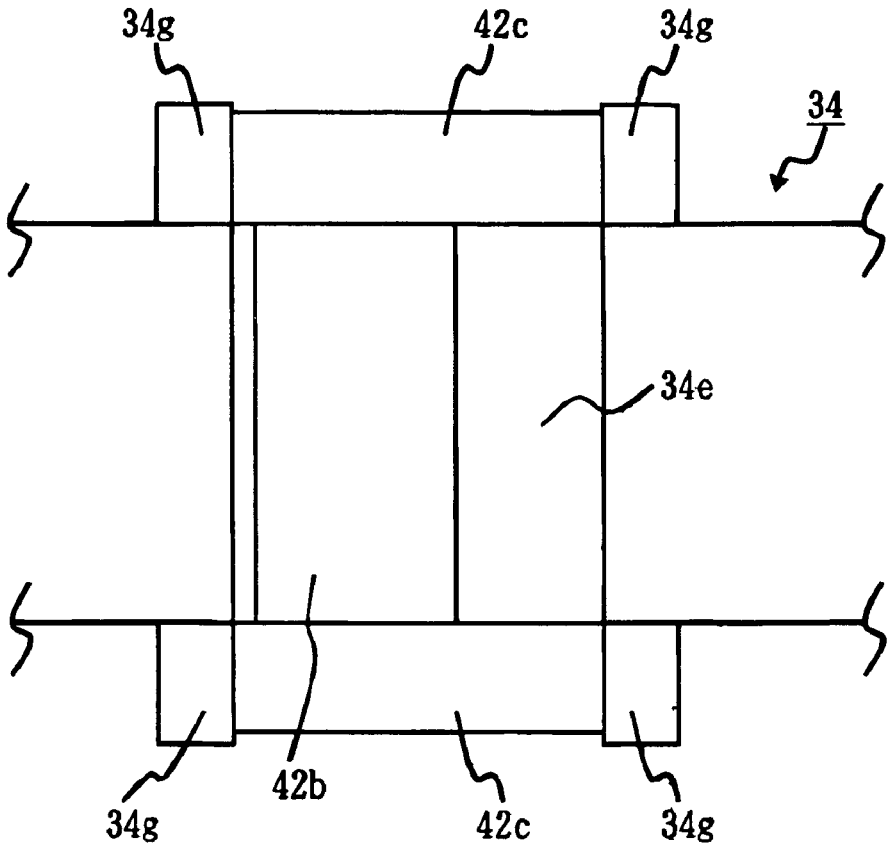
FIG. 20 is a schematic view No. 4 showing the relationship between the eccentric cam and the spacer according to the second embodiment of the present invention.

FIG. 17 is a schematic view No. 1 showing a relationship between the eccentric cam 42 and the spacer 38*a* according to a second embodiment of the present invention. FIG. 18 is a schematic view No. 2 showing the relationship between the eccentric cam 42 and the spacer 38*a* according to the second embodiment of the present invention. FIG. 19 is a schematic view No. 3 showing the relationship between the eccentric cam 42 and the spacer 38*a* according to the second embodiment of the present invention. FIG. 20 is a schematic view No. 4 showing the relationship between the eccentric cam 42 and the spacer 38*a* according to the second embodiment of the present invention. Note that FIG. 20 is a view of the eccentric cam 42 and the lens array holder 34 viewed from a side of the spacer 38*a*.

As shown in FIGS. 17 to 19, the lens array holder 34 is provided as the supporting member and the chassis, and the spacer 38*a* is provided as an abutting member is disposed on the surface of the photosensitive drum (refer to FIG. 3) as the image supporting member. The spacer 38*a* has the abutting surface S2. The eccentric cam 42 includes the shaft portion 42*b* and the cam portion 42*c*, and the cam portion 42*c* has the outer circumferential surface S11.

In the embodiment, a groove 34*e* with a rectangular shape is formed in the lens array holder 34 for accommodating a part of the shaft portion 42*b*. Holding portions 34*g* are formed at both edge portions of the lens array holder 34 to protrude for holding the cam portion 42*c* from both sides.

In the embodiment, the holding portions 34*g* hold the cam portion 42*c* from both sides to be freely rotatable and slidable in a state that the shaft portion 42*b* abuts against a bottom surface 34*h* of the groove 34*e* until the focal point is completely adjusted.

As shown in FIGS. 17 to 19, when the shaft portion 42*b* rotates inside the groove 34*e* to change a position of the shaft portion 42*b* in the groove 34*e*, the cam portion 42*c* rotates in the state that the holding portions 34*g* hold the cam portion 42*c*. Accordingly, a position relative to the lens array holder 34 changes in a contact-separate direction, thereby changing the distance L2 (refer to FIG. 4). After the focal point is completely adjusted, the eccentric cam 42 is fixed to the lens array holder 34 with an adhesive.

As described above, in the embodiment, the cam portion 42*c* rotates in the state that the holding portions 34*g* hold the cam portion 42*c*. Accordingly, the position relative to the lens array holder 34 changes in the contact-separate direction, thereby changing the distance L2. As a result, it is possible to prevent a contact point pf between the abutting surface S2 of the spacer 38*a* and the outer circumferential surface S11 of the cam portion 42*c* from shifting.

Accordingly, it is possible to maintain the distance L2 constant, thereby preventing the focal point from shifting. As a result, it is possible to accurately adjust the distance between the rod lens array 32 as the optical system or the lens array and the photosensitive drum 13Bk, and to make the adjustment operation simple.

In the embodiments described above, the present invention is applied to the printer as the image forming apparatus, and is applicable to a copier, a facsimile, a multi-function product, and the likes.

The disclosure of Japanese Patent Application No. 2007-190555, filed on Jul. 23, 2007, is incorporated in the application.

While the invention has been explained with reference to the specific embodiments of the invention, the explanation is illustrative and the invention is limited only by the appended claims.

What is claimed is:

1. An exposure device comprising:

a light emitting element;

a supporting member for supporting the light emitting element, said supporting member including a holding portion, said holding portion including a transverse channel with a U-shaped cross-section; and an eccentric cam for adjusting a distance between the light emitting element and a light receiving member, said eccentric cam including a shaft portion and a cam portion arranged eccentrically relative to the shaft portion, said cam portion being received by the transverse channel and supported on the holding portion to be rotatable, wherein the cam portion is situated adjacent to the holding portion and ends the transverse channel when the eccentric cam is received by the transverse channel.

2. The exposure device according to claim 1, wherein said holding portion includes at least two sides for holding the cam portion to be freely slidable.

3. The exposure device according to claim 1, wherein said holding portion is arranged to hold the shaft portion so that a movement of the shaft portion in a first direction between the light emitting element and the light receiving member is restricted and the shaft portion is movable in a second direction perpendicular to the first direction.

4. The exposure device according to claim 1, wherein said eccentric cam is arranged to adjust the distance between the light emitting element and the light receiving member including an image supporting member.

5. An image forming apparatus comprising the exposure device according to claim 1.

6. An LED head comprising:

an LED array chip formed of a plurality of LEDs;

an optical system disposed between the LED array chip and a light receiving member for collecting light emitted from the LEDs;

a supporting member for supporting the optical system, said supporting member including a holding portion, said holding portion including a transverse channel with a U-shaped cross-section; and an eccentric cam disposed between the optical system and the light receiving member to be rotatable for adjusting a distance between the optical system and the light receiving member, said eccentric cam including a shaft portion and a cam portion arranged eccentrically relative to the shaft portion, said cam portion being received by the transverse channel and supported on the holding portion to be rotatable, wherein the cam portion is situated adjacent to the holding portion and ends of the transverse channel, when the eccentric cam is received by the transverse channel.

7. The LED head according to claim 6, wherein said eccentric cam is arranged to adjust the distance between the optical system and the light receiving member including an image supporting member.

8. The LED head according to claim 6, wherein said holding portion includes at least two sides for holding the cam portion to be freely slidable.

9. The LED head according to claim 6, wherein said holding portion is arranged to hold the shaft portion so that a movement of the shaft portion in a first direction between the optical system and the light receiving member is restricted and the shaft portion is movable in a second direction perpendicular to the first direction.

* * * * *